US006533304B2

(12) United States Patent
Lizama-Troncoso et al.

(10) Patent No.: US 6,533,304 B2
(45) Date of Patent: Mar. 18, 2003

(54) MECHANICALLY ASSISTED STANDING WHEELCHAIR

(75) Inventors: Mauricio Anibal Lizama-Troncoso, San Juan, PR (US); David Serrano-Acevedo, Mayaguez, PR (US); Dennis Martell-Solares, Flower Mound, TX (US); Eduardo F. Carlo-López, San Juan, PR (US); Eduardo Bravo-Rios, San Juan, PR (US)

(73) Assignee: University of Puerto Rico, San Juan, PR (US)

( * ) Notice: Subject to any disclaimer, the term of this patent is extended or adjusted under 35 U.S.C. 154(b) by 0 days.

(21) Appl. No.: 09/728,893

(22) Filed: Dec. 2, 2000

(65) Prior Publication Data

US 2001/0024025 A1 Sep. 27, 2001

Related U.S. Application Data

(60) Provisional application No. 60/168,384, filed on Dec. 2, 1999.

(51) Int. Cl.[7] ..... A47C 1/02
(52) U.S. Cl. ..... 280/250.1; 297/DIG. 4
(58) Field of Search ..... 280/250.1, 304.1; 297/DIG. 4

(56) References Cited

U.S. PATENT DOCUMENTS 3,964,786 A * 6/1976 Mashuda ..... 180/315
4,519,649 A * 5/1985 Tanaka et al. ..... 297/316
4,862,997 A * 9/1989 Eberle ..... 182/148
5,108,202 A * 4/1992 Smith ..... 297/316
5,556,121 A * 9/1996 Pillot ..... 180/907

FOREIGN PATENT DOCUMENTS

FR 2697418 A1 * 5/1994 ..... A47C/1/022

* cited by examiner

*Primary Examiner*—Kevin Hurley
(74) *Attorney, Agent, or Firm*—Patent Law Offices of Heath W. Hoglund

(57) ABSTRACT

The present invention provides a hydraulic powered wheelchair pivotable from a sitting position to a standing position with minimal user effort. The pivoting frame assembly includes a rigid horizontally arranged wheel support structure, a single vertical extending member secured to the wheel support structure and centered between the wheels, and a pivoting frame linkage assembly pivotably connected at the upper end of the vertically extending member. A hydraulic jack rests on the wheel support structurs, and is connected at the other end to the seat support members of the pivoting assembly. A user of the wheelchair pivots a lever assembly to raise the jack, and thus raise the chair to the standing position. An electric buzzer system is integrated with the wheelchair, and an alarm informs the operator when the chair has reached the standing position.

19 Claims, 16 Drawing Sheets

MECHANICALLY ASSISTED STANDING WHEELCHAIR

CLAIM OF PROPERTY

This application claims the benefit of priority to U.S. patent application Ser. No. 60/168,384 filed on Dec. 2, 1999.

FIELD OF THE INVENTION

The present invention relates to a portable wheelchair with a simplified frame construction which can be raised to a standing position with a minimal effort from the user.

BACKGROUND OF THE PRIOR ART

Wheelchairs which can be raised from a sitting position to a standing position are well known in the art. Some of the wheelchairs require more effort from the user to raise the chair into the standing position. U.S. Pat. No. 4,519,649 to Tanake et al. shows a wheelchair with a gas spring placed in a compressed state when the chair is in the sitting position. When the user desires to raise the chair to the standing position, the compressed gas spring is gradually released to raise the chair. However, the gas spring does not produce all the force needed to raise the person sitting in the chair. Effort on behalf of the user is required in addition to that provided by the gas spring. A person without full upper body strength would not have enough power to raise the chair. The gas spring could be increased in stored power to raise the person without much effort, but then the person would need additional effort to lower the chair to the sitting position in order to overcome the stronger gas spring.

Another device, U.S. Pat. No. 5,108,202 to Smith, makes use of a hydraulic jack to raise the chair to a standing position. A hydraulic jack could be used by a person with limited strength to raise the chair, since the leverage of the input device to the jack could be modified so that little force is required to drive the pumping unit of the jack.

One of the disadvantages of the above wheelchairs, and others in the prior art, is that the chairs use a double frame structure. The frame comprises a left side frame and a right side frame. The sides are connected together by cross members to form the frame structure. Using this double frame structure increases the cost of materials and manufacture of the chair. Also, in a wheel chair which uses a hydraulic jack, the cross members must be strong enough to support the load developed by extending the hydraulic jack. The side members must also be reinforced since the cross members connect to the side members.

Further, the wheelchairs that have raising capabilities do not provide any means by which to notify the user when the chair has reached the raised position in order that the user does not waste additional effort.

SUMMARY OF THE INVENTION

The objects of the present invention are to provide a wheelchair with an ability to raise a person to a standing position requiring minimal effort by the user.

Another object of the present invention is to provide a standing assist type wheelchair with the mobility of a normal wheelchair (non-standing assisted type).

Another object of the present invention is to provide a wheelchair which uses a hydraulic jack with a simplified frame construction.

A further object of the present invention is to provide the wheelchair with a device to alert the user when the chair has reached the raised position.

Additional objects and advantages of the invention will be set forth in part in the description which follows, and in part will be obvious from the description, or may be learned by practicing the invention. The objects and advantages of the invention will be realized and attained by means of the elements and combinations particularly pointed out in the appended claims.

To achieve the objects and in accordance with the purpose of the invention, as embodied and broadly described herein, the invention includes a wheelchair having a frame supporting two foot rests, a seat and a back rest of the wheelchair. The frame consists of a single frame extending between the center of the foot rests, the seat and the back rest, and the frame is supported for pivoting or tilting motion by a wheel axle frame section. The first and most preferred embodiment uses a hydraulic system to raise the seat, while a second and third embodiment uses a toggle and ratchet system, and a fixed lever and spring assisted device, respectively. The hydraulic system offers a high mechanical advantage, an integrated lowering system, low maintenance, little user effort to activate the lifting system, and high cost effectiveness.

Another feature of the invention is an electrical buzzer that beeps when the seat has reached its final and upright position so that the user does not continue trying to raise the seat.

According to one aspect of the invention a wheelchair includes a central frame, a wheel frame and a lift. The central frame has a back, a seat and a leg support. The back support is pivotably attached to the seat support and the seat support is pivotably attached to the leg support. The wheel frame has a rear member and two wheels connected thereto. The wheel frame also has a front member and two wheels connect connected thereto. The front member connects to the rear member of the wheel frame. The lift is positioned between the wheel frame and the central frame. A user may operate the lift to move the central frame from a sitting position to a standing position.

According to another aspect of the invention a wheelchair includes a lower frame, an upper frame, a vertical member and a lift. The lower frame is coupled with a plurality of wheels. The upper frame has a back member, a plurality of seat members, and a leg member. The back member pivotably attaches to one end of the plurality of seat members. The leg member pivotably attaches to the opposite end of the plurality of seat members. The vertical member rigidly attaches to the lower frame and pivotably attaches to the plurality of seat members. The vertical member is positioned between the two ends of the seat members. The lift has a bottom and a top. The bottom rests upon the lower frame and the top presses against at least one of the plurality of seat members. The lift is positioned between the vertical member and the end of the plurality of seat members that attaches to the back.

It is to be understood that both the forgoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

Figure 1:
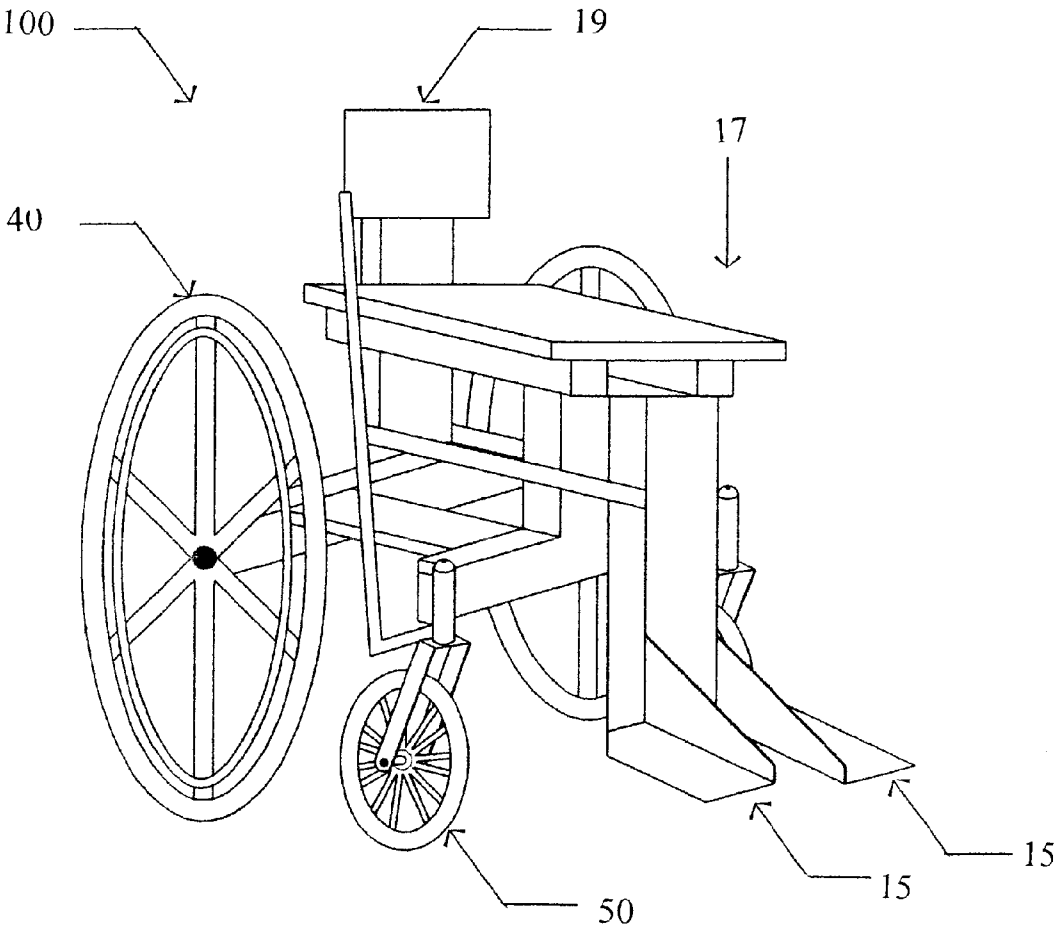
FIG. 1 is an isometric view of the preferred embodiment of the wheelchair in a sitting position.
Figure 2:
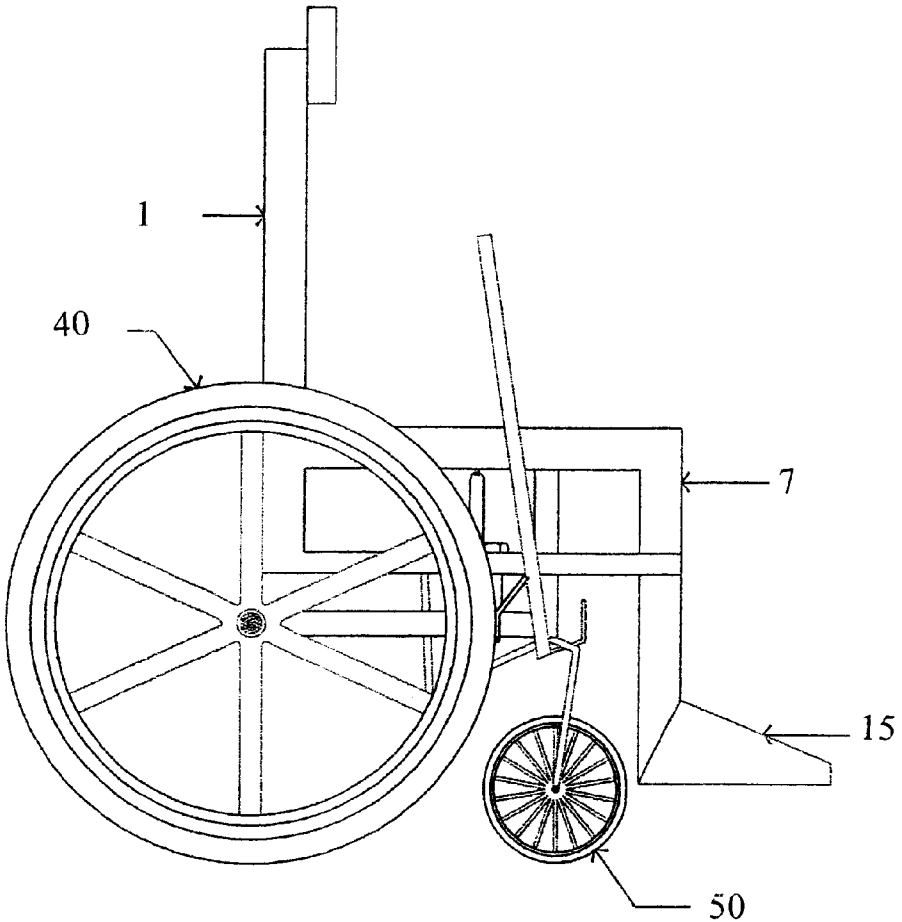
FIG. 2 is a side view of the wheelchair of FIG. 1 in the sitting position.
Figure 3:
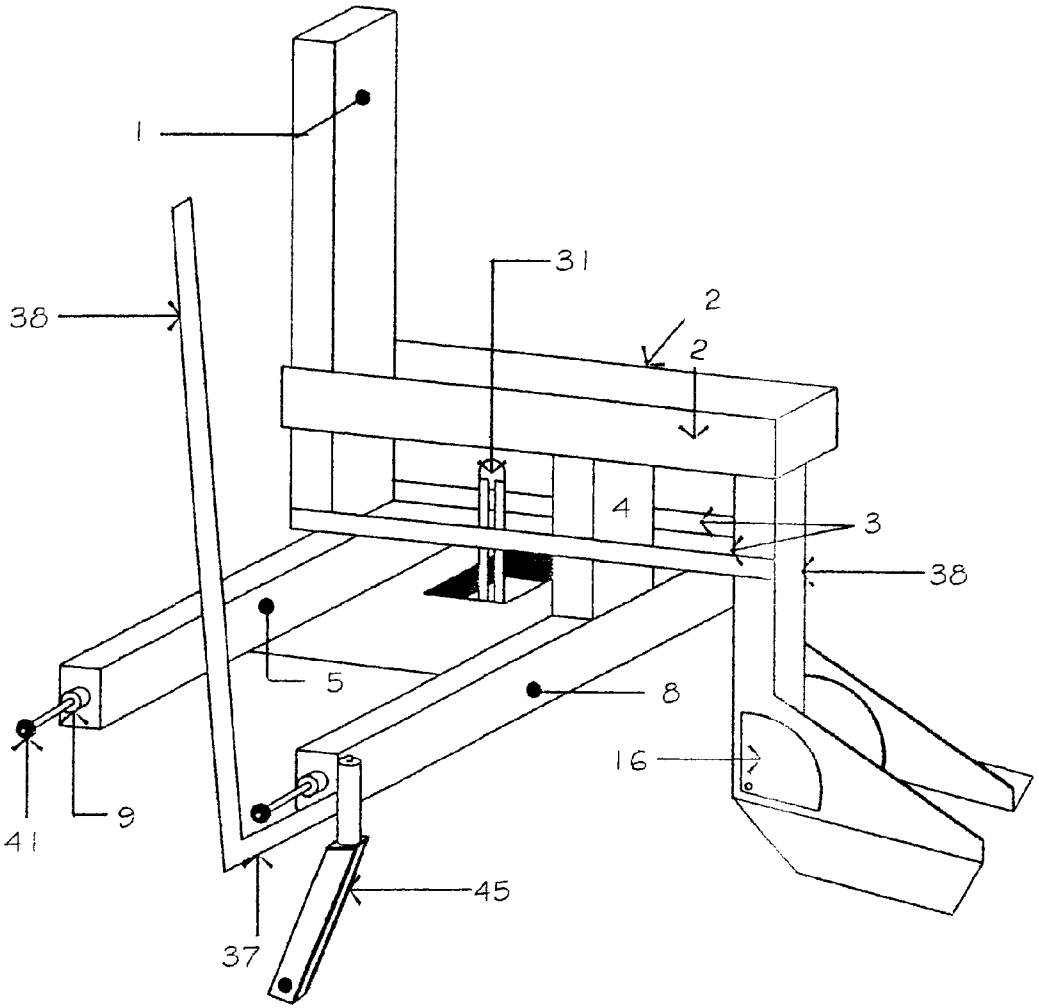
FIG. 3 is an isometric view of a chassis structure of the wheelchair of FIG. 1.

The present invention includes a wheelchair having a central frame construction including a wheel axle frame and a pivoting chair portion, and a power mechanism for moving the pivoting chair portion between a sitting position and a raised position. As embodied herein and shown in FIGS. 3, 5A and 5B, the preferred embodiment of the wheelchair 100 has a centrally positioned, single frame construction to reduce material and construction costs. The central single frame includes a wheel axle frame.

Wheel axle frame includes a front wheel support 8 and a rear wheel support 9, with two chassis base members 5 extending between the front wheel support 8 and the rear wheel support 9. A vertical support 4 extends upwardly from the wheel axle frame and is located adjacent front wheel support 8 and between the two chassis base members 5.

Figure 6:
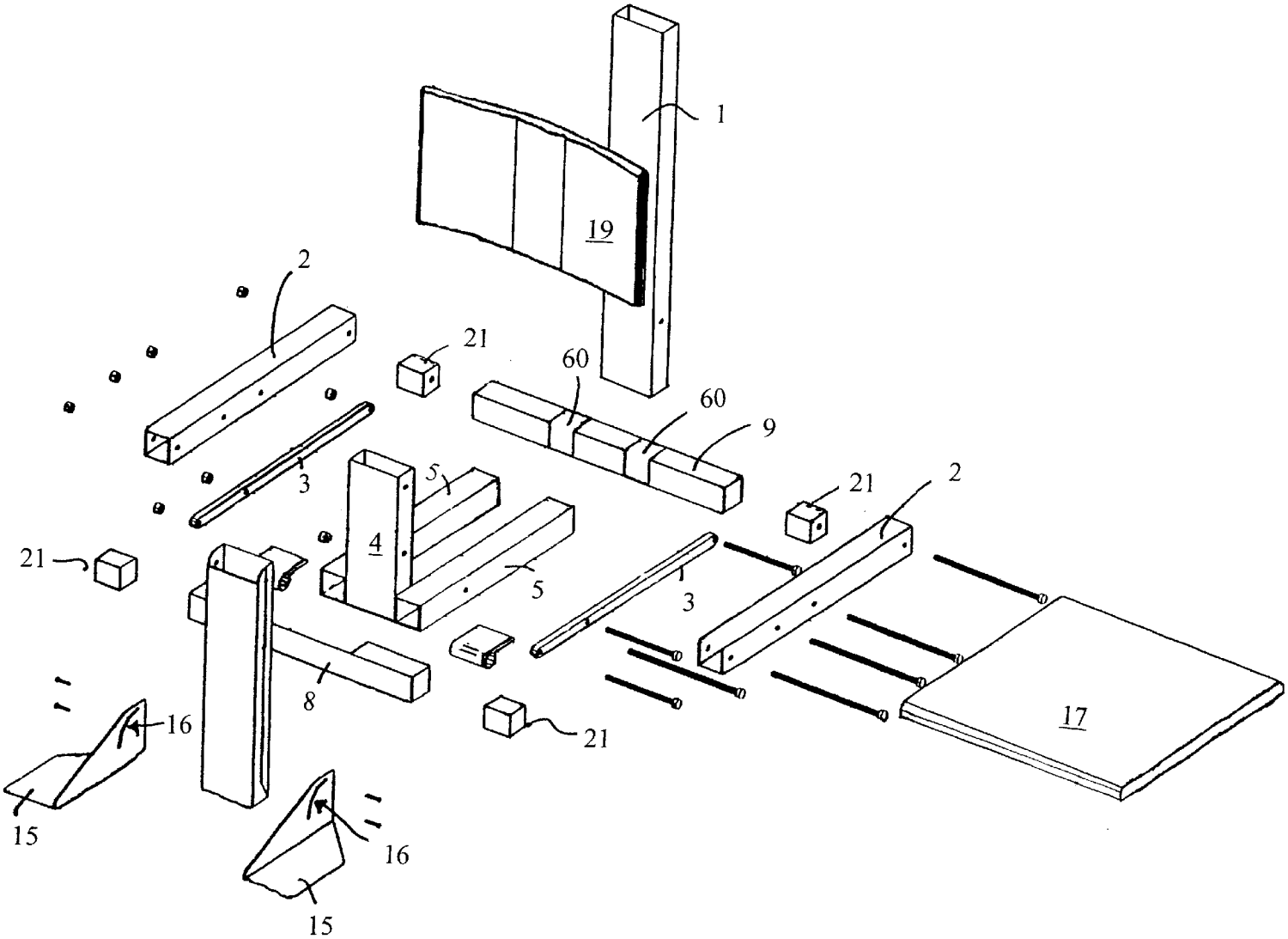
FIG. 6 is an exploded view of a chassis assembly of the wheelchair of FIG. 1.
Figure 8:
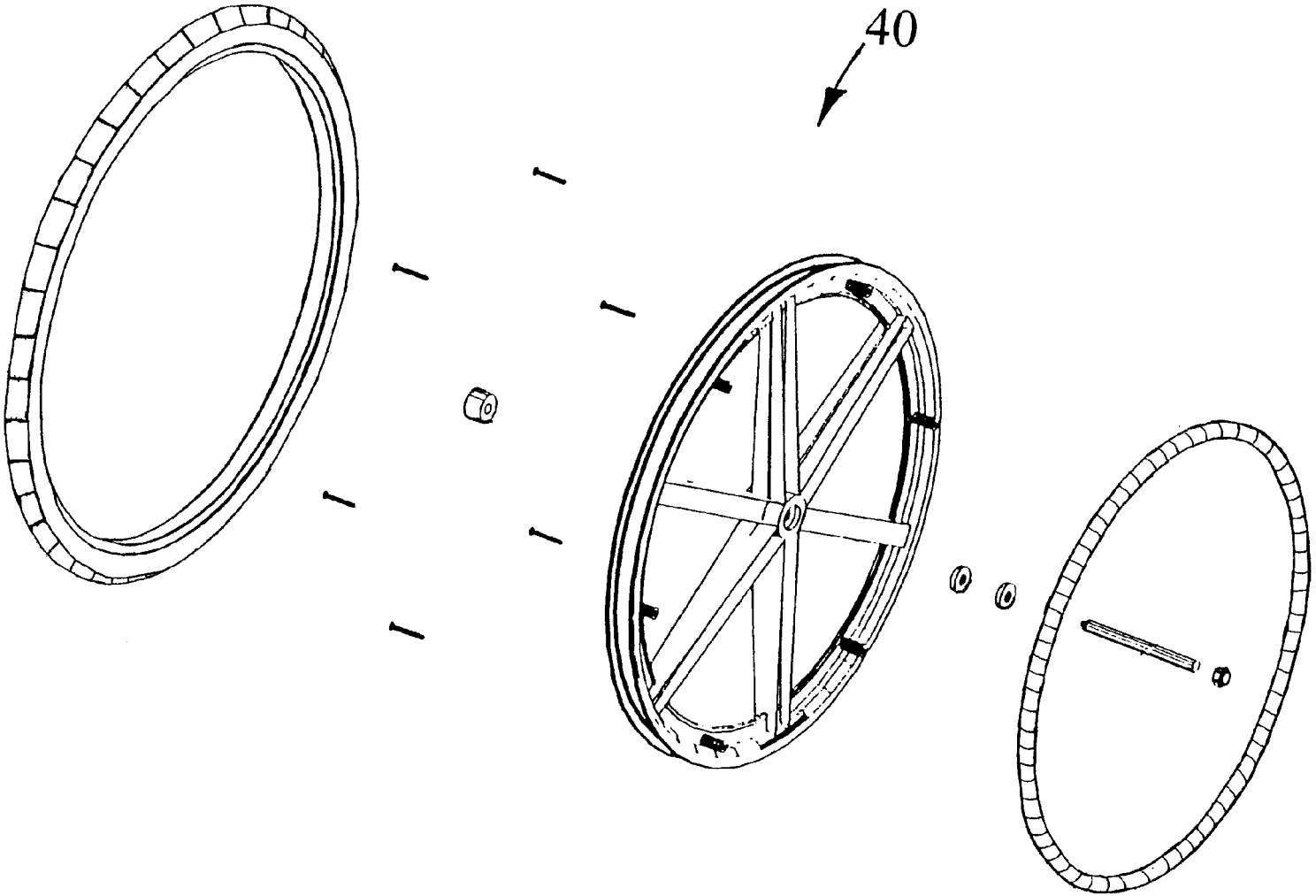
FIG. 8 is an exploded view of a rear wheel assembly for the wheelchair of FIG. 1.
Figure 9:
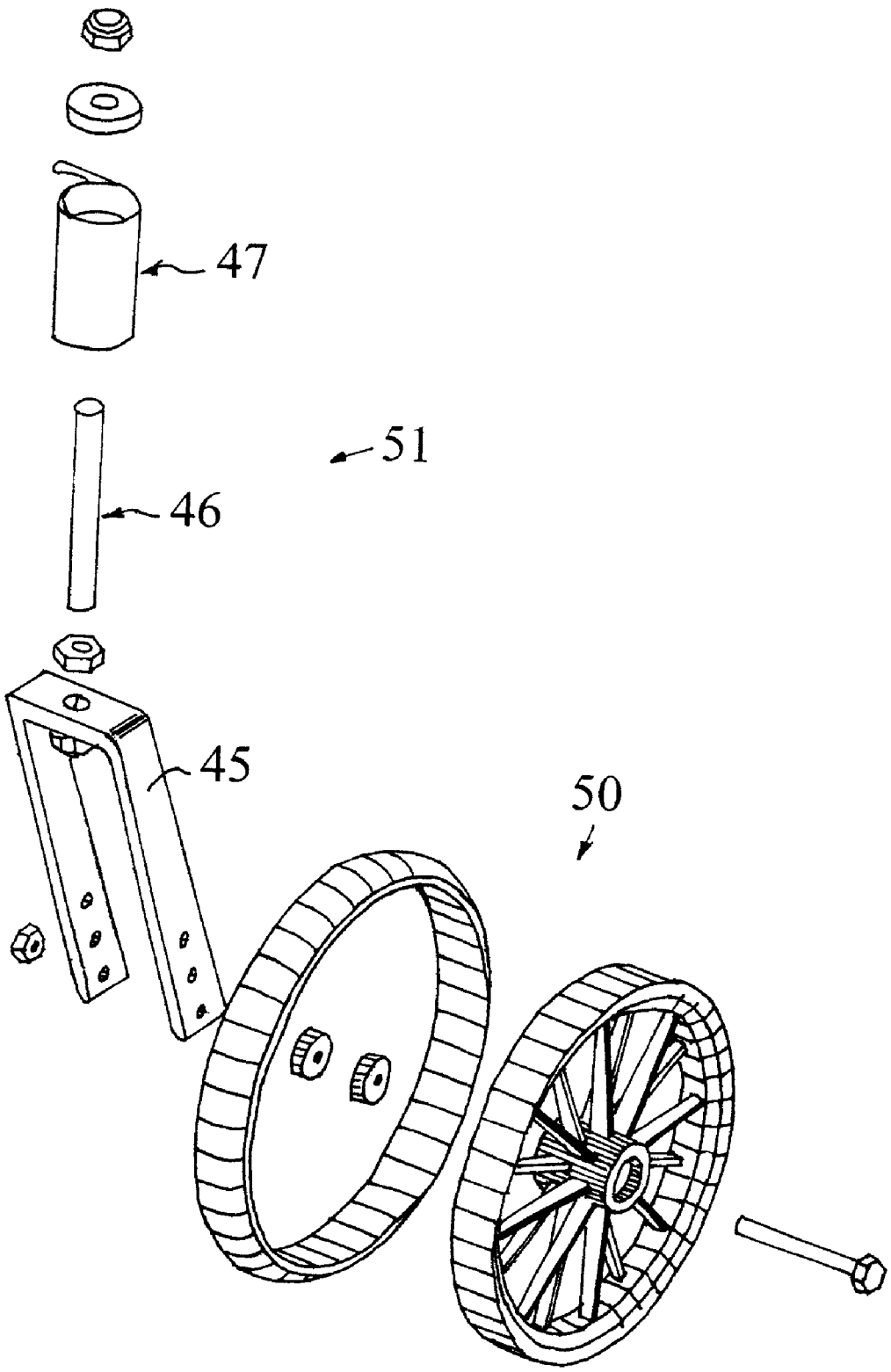
FIG. 9 is an exploded view of a front wheel assembly for the wheelchair of FIG. 1.

Four axle support blocks 21 are positioned in the ends of the front 8 and rear 9 wheel supports (FIG. 6). Each block 21 has a hole in which an axle to support the wheels can pass through. Two rear wheels 40 are connected to an axle 41 mounted in the support blocks on both ends of the rear wheel support 9 (FIG. 8). A front wheel assembly 51 (FIG. 9) includes U-shaped support member 45, a vertical shaft member 46, and a bushing 47. The bushing 47 fits in a hole provided near the ends of the front wheel supports 8. Washers and nuts are used to secure the members of the front wheel support assembly 51 together. Smaller front wheels 50 are mounted to the U-Shaped member 45 by a bolt passing through holes formed near the bottom of the U-Shaped member 45. The U-Shaped member 45 is slanted towards the rear of the axis of the vertical shaft member 46 in order to provide stability to the front wheel when the wheelchair is moving. The front wheels are free to rotate in the bushings 47.

The front and rear supports 8 and 9 and the two base chassis members 5 form a rigid support structure for the pivoting chair structure described below.

Pivotably connected to the top end of the vertical support 4 is the chair structure. The pivotable chair structure includes back support 1, seat base members 2, a leg support 7, and foot supports 15. Pivotably connected to the top end of vertical support 4 are central portions of seat base members 2, with one seat base member extending along either side of vertical support 4. Pivotably connected to and positioned between the rear ends of seat base members 2 is a central portion of back support 1. Pivotably connected to and positioned between the front ends of seat base members 2 is the top end of leg support 7. Also connecting and positioned on either side of the bottom end of back support 1, the central portion of vertical support 4, and the central portion of leg support 7 are two four-bar link members 3.

Connected to the bottom end of the leg support 7 are two foot support members 15. Each foot support 15 has a curved slot 16 therein so that the angular position of the foot supports 15 can be adjusted with respect to the leg support 7. Two screws hold the foot supports 15 to the leg support 7. A padded back rest 19 is connected to the back support 1, and a padded seat base 17 is connected to the seat base members 2 (FIG. 6).

Figure 5A:
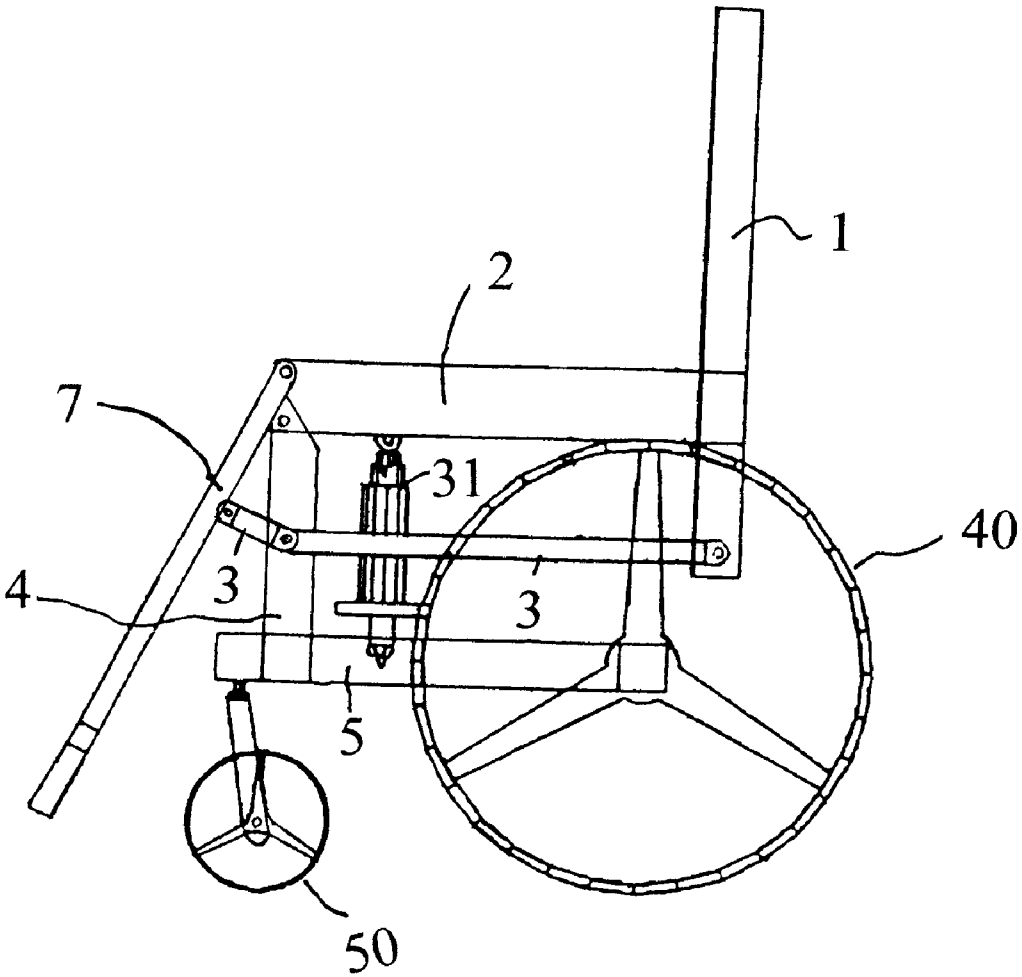
FIG. 5A is a schematic side view of the wheelchair of FIG. 1.
Figure 5B:
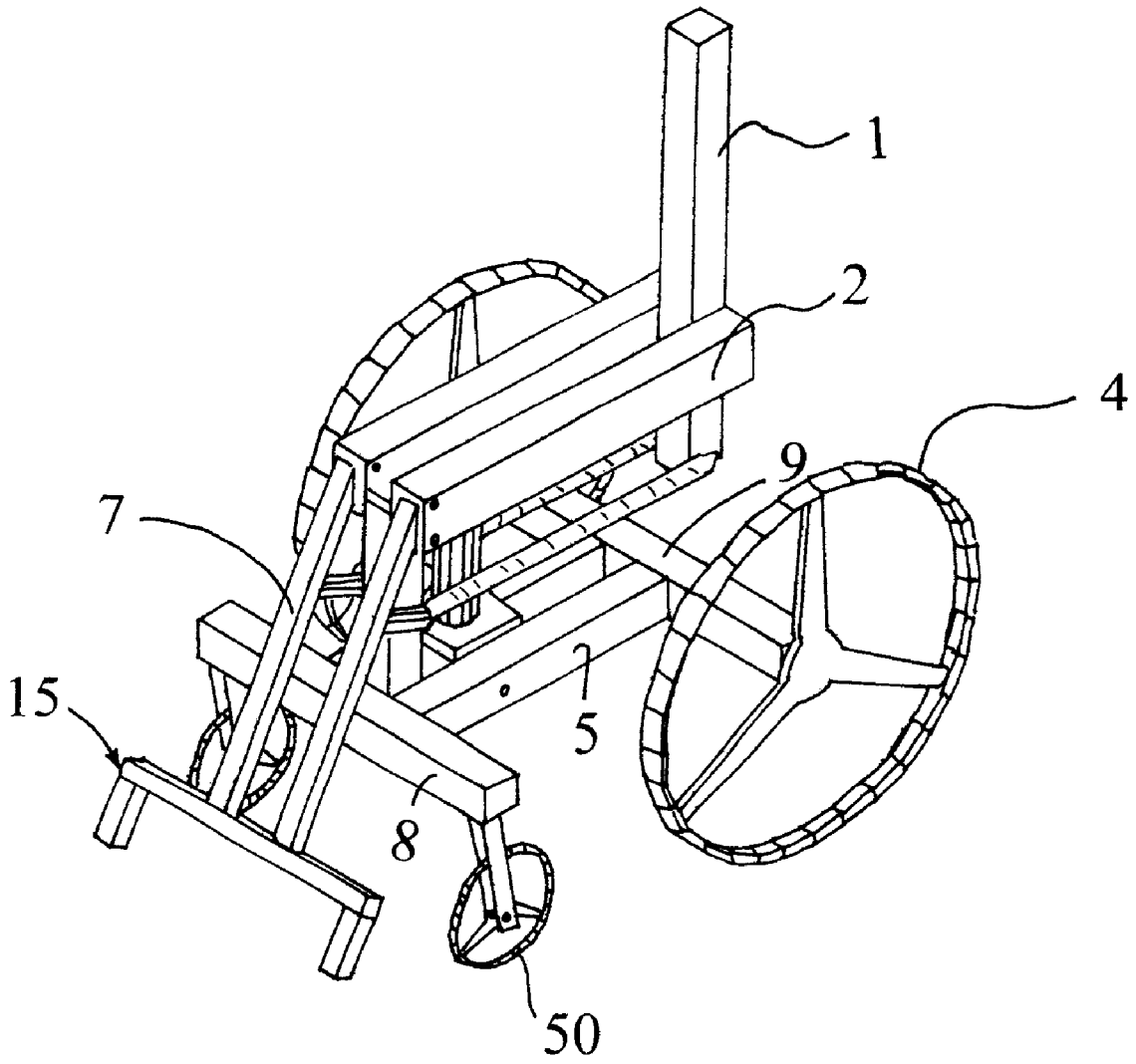
FIG. 5B is a schematic isometric view of the wheelchair of FIG. 1.
Figure 7:
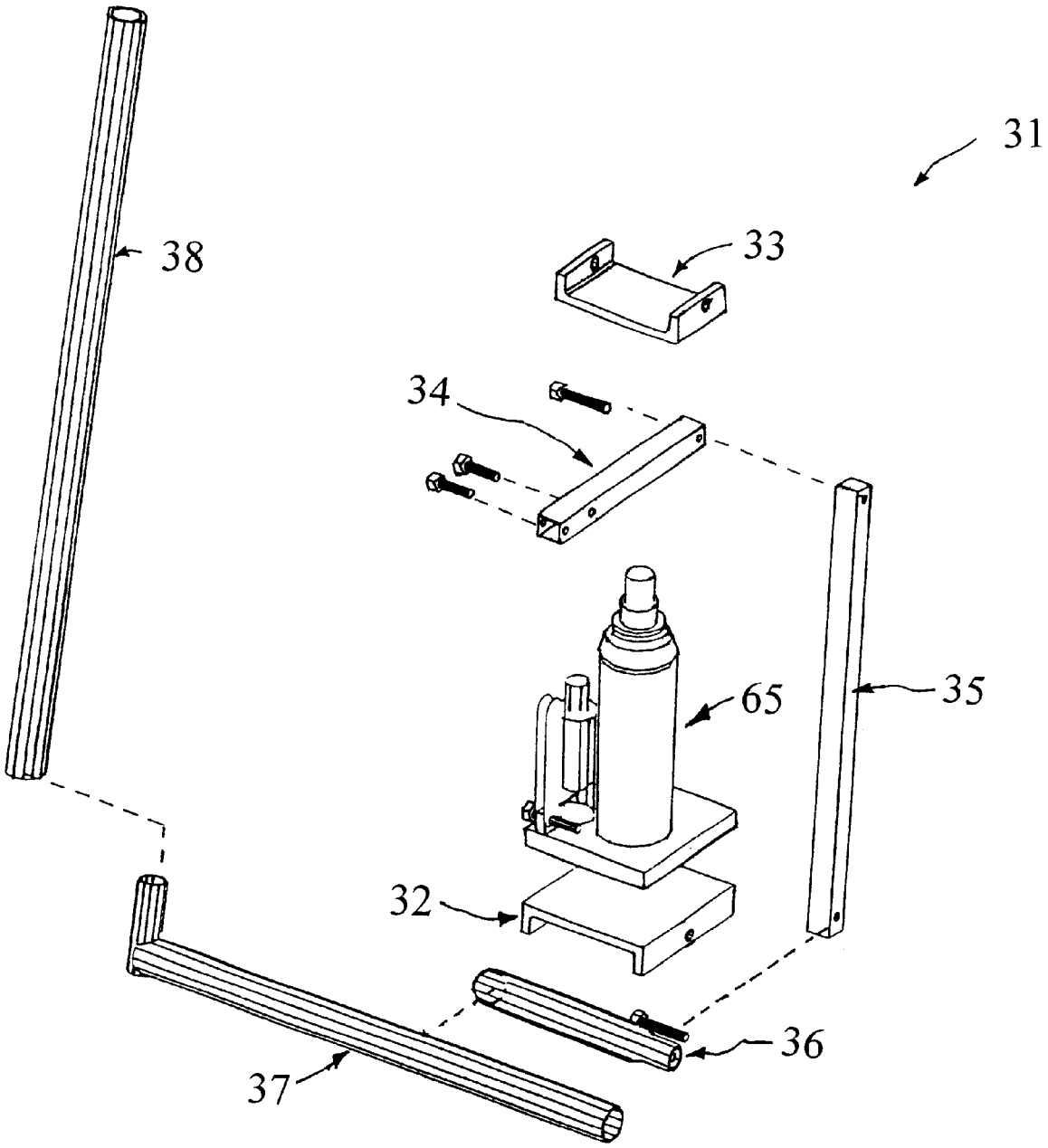
FIG. 7 is an exploded view of hydraulic jack assembly for the wheelchair of FIG. 1.

As embodied herein and shown in FIGS. 5A and FIG. 7, the wheelchair of the present invention includes a power mechanism for moving the pivoting chair portion between a sitting position and a raised position.

In a first and most preferred embodiment, a hydraulic jack assembly is used to pivot the chair from the sitting position to the raised position. A hydraulic jack 31 is attached to a lower jack base 32. The lower jack base 32 has a hole therein for connection to the chassis base members 5. The extending part of the jack (top part) is connected to an upper jack base 33 which also has a hole therein for connection to the seat base members 2. The connections in the two jack bases are pivotable connections. An activating lever assembly is comprised of a lever members 34, 35, 36, 37 and 38, and forms a means for the user to activate the hydraulic pump 65 while sitting in the wheelchair. Lever 38 forms a handle for a user to actuate the hydraulic jack 31.

The hydraulic jack is a standard jack which can be purchased at a department store or auto parts store, and requires little effort from the user in order to raise the seat. Thus, a person having limited upper body strength can power the jack without additional aid in order to raise the chair to the standing position.

Figure 12A:
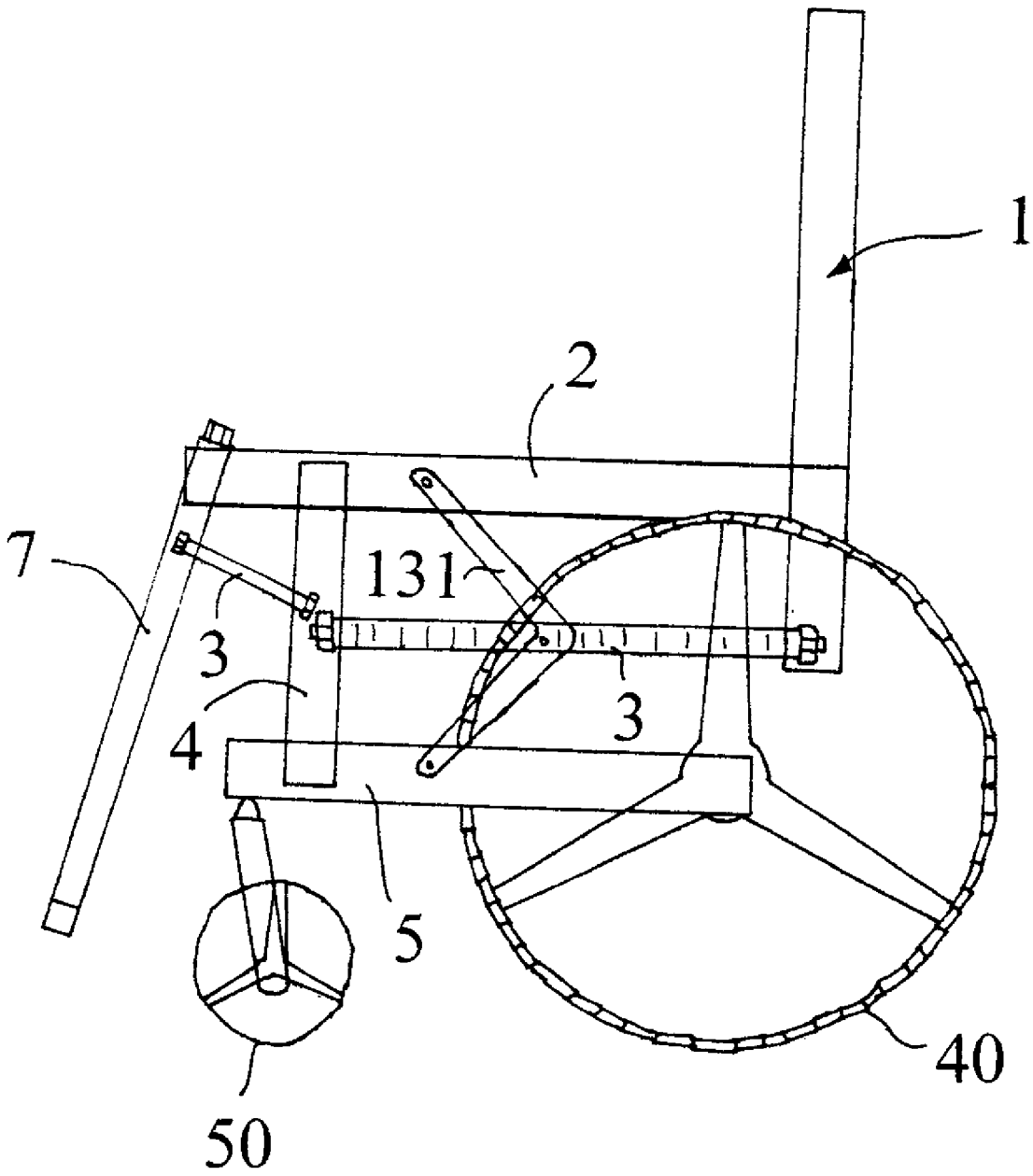
FIG. 12A is a schematic side view of a second embodiment of the wheelchair using a ratchet and toggle mechanism.
Figure 12B:
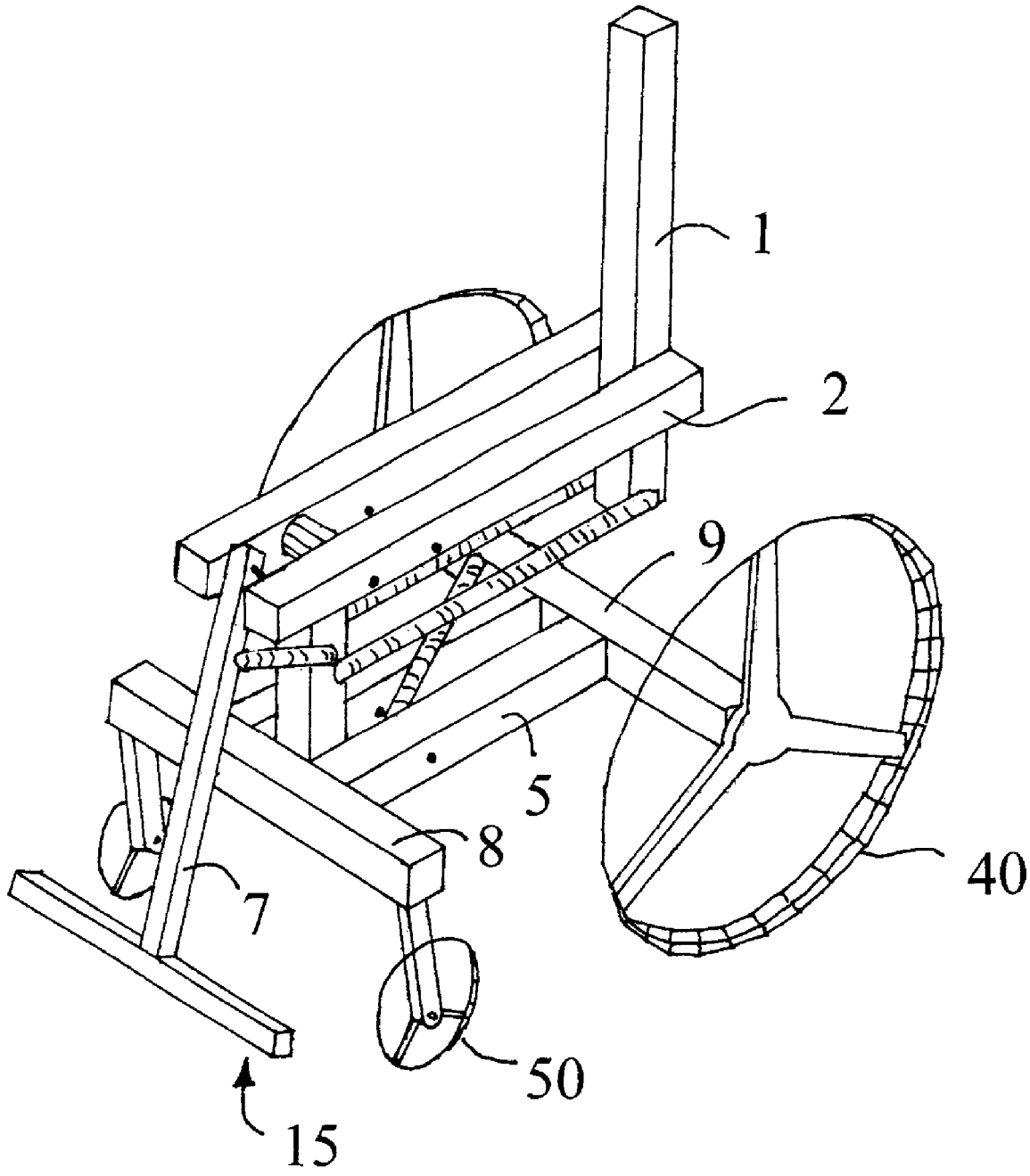
FIG. 12B is a schematic isometric view of a wheelchair of FIG. 12A.
Figure 13A:
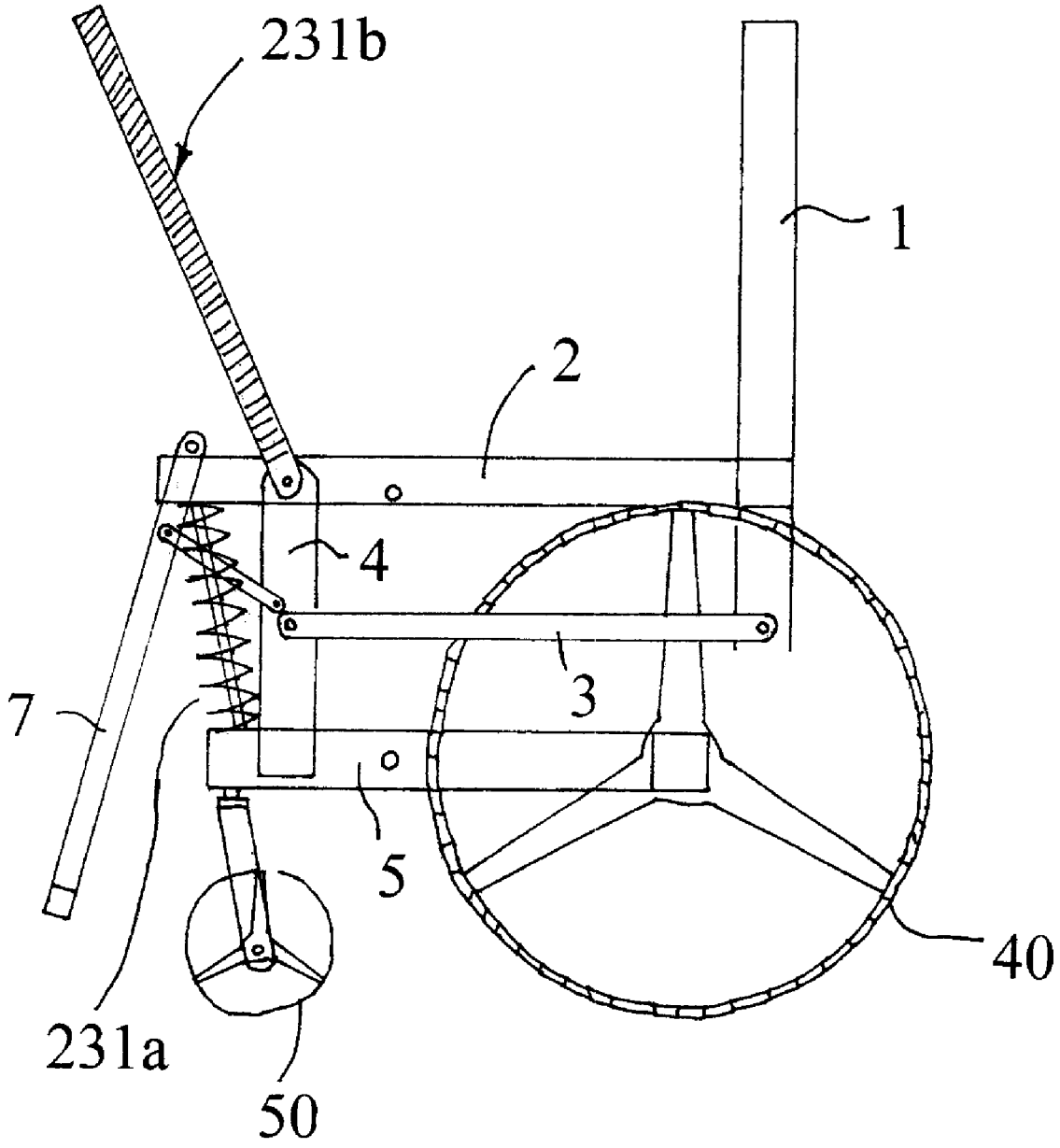
FIG. 13A is a schematic side view of a third embodiment of the wheelchair using a spring and fixed level mechanism.
Figure 13B:
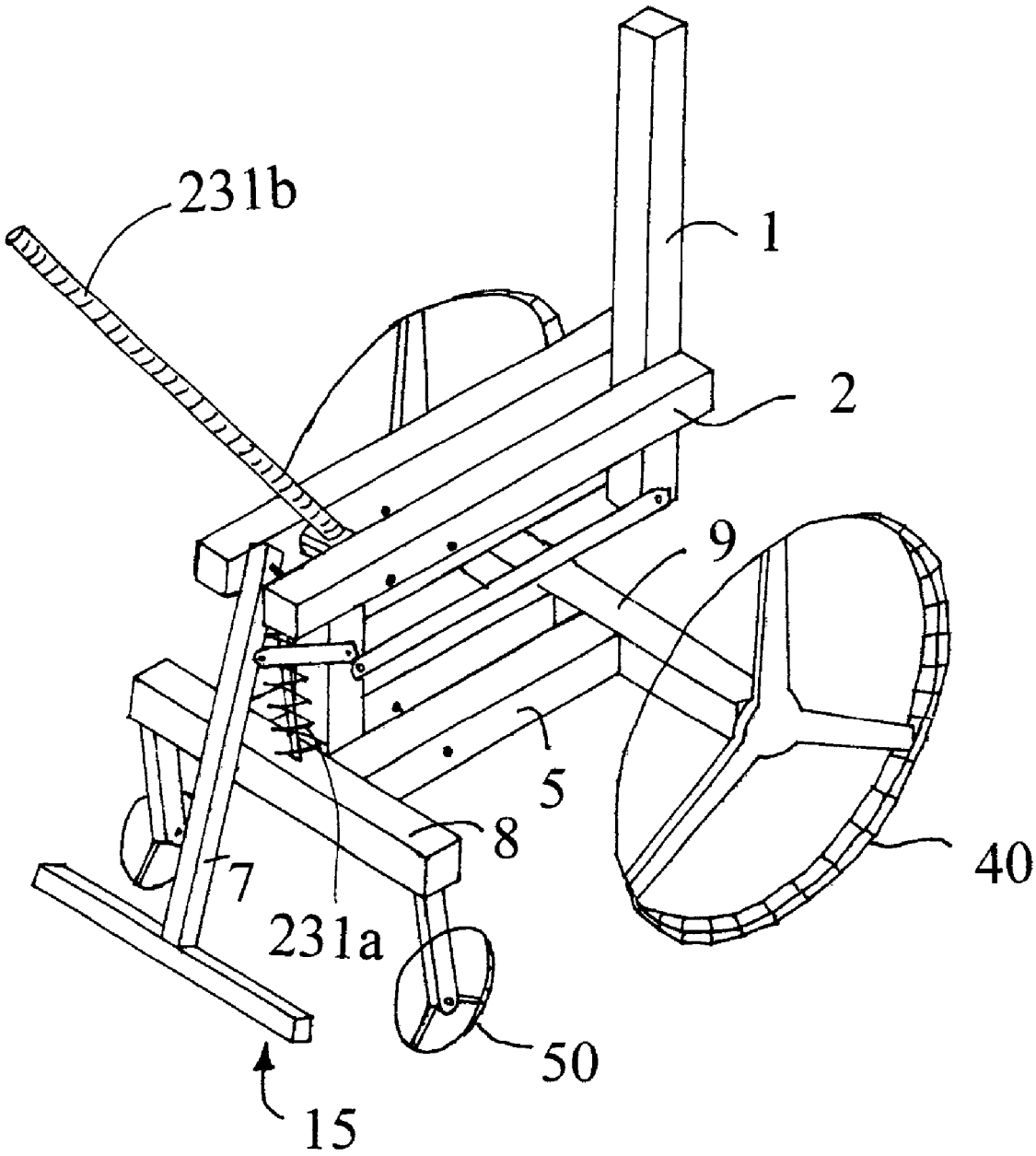
FIG. 13B is a schematic isometric view of the wheelchair of FIG. 13A.

Alternatively, in a second embodiment of the present invention as shown in FIGS. 12A and 12B, a ratchet and toggle mechanism may be used instead of a hydraulic jack to raise the chair from the sitting position to the standing position. In a third embodiment of the present invention shown in FIGS. 13A and 13B, the wheelchair is raised by a spring and fixed lever.

Figure 10:
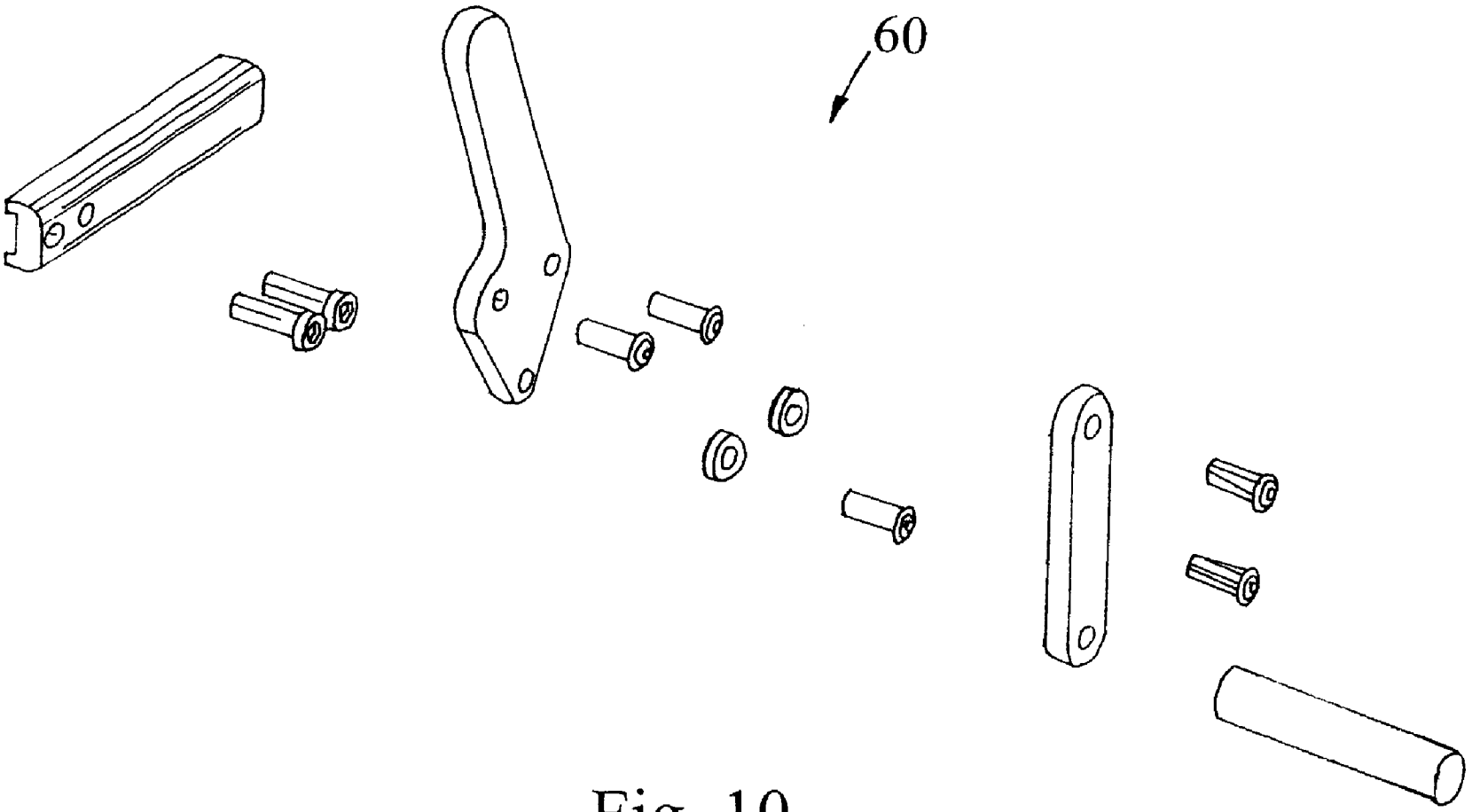
FIG. 10 is an exploded view of a wheel lock assembly for the wheelchair of FIG. 1.

As embodied herein and shown in FIG. 10, a wheel lock assembly 60 is used to prevent the wheelchair from moving during the operation of raising the chair from the sitting position to the standing position. The wheel lock 60 is mounted near the end of one side of the front wheel support 8, facing the rear wheel 40. The wheel lock is used to lock the rear wheel from rotation in order that the wheelchair will not roll.

Figure 11:
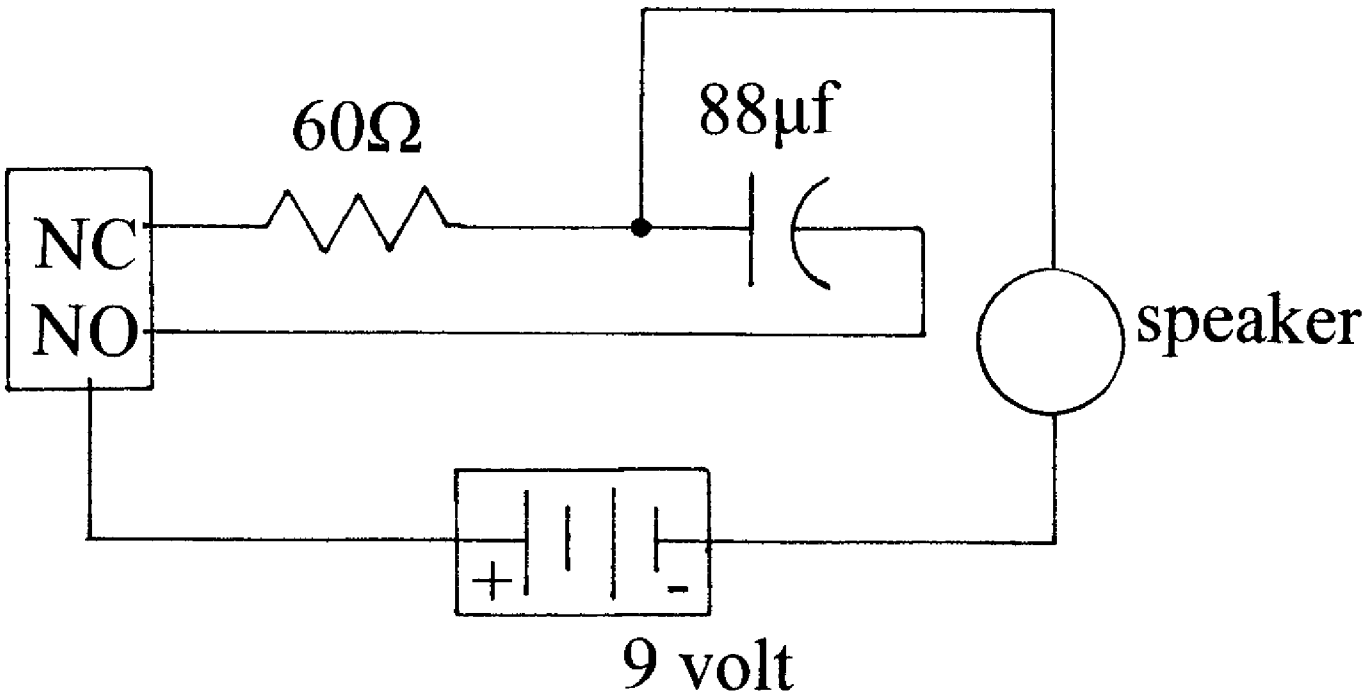
FIG. 11 is a circuit diagram for an electric buzzer of the wheelchair of FIG. 1.

As embodied herein and shown in FIG. 11, the present invention includes means for alerting the wheelchair user that the raising or lowering operation is complete. The preferred means for alerting the wheelchair user is an electric buzzer system. Alternatively, other means such as a bell system could be used.

Described below is an example of the preferred embodiment of the wheel axle frame and the pivoting chair portion of the central frame of the present invention.

The wheel axle frame includes a front wheel support 8 and a rear wheel support 9, with two chasis base members 5 extending between the front wheel support 8 and the rear wheel support 9. A vertical support 4 extends upwardly from the wheel axle frame and is located adjacent front wheel support 8 and between the two chassis base members 5. The rear wheel support 9 is approximately 20.5 inches in length, while the front wheel support 8 is approximately 18 inches in length. The two chassis base members 5 are approximately 17 inches in length, and are connected to cutout sections 60 on both the front and rear wheel supports 8 and 9. The spacing between the chassis base members 5 is approximately four inches, the width of a vertical support 4. The rear and front wheel supports 9 and 8 and the two chassis base members 5 are preferably made from 2-inch square aluminum tubing having a wall thickness of ⅛ inch. Preferably, the vertical support 4 is approximately 11 inches in length and connected at its bottom end to the two chassis support members 5 and the front wheel support 8. The front and rear wheel supports 8 and 9 and the two base chassis members 5 from a rigid support structure for the pivoting chair structure described below.

Pivotally connected to the top end of the vertical support 4 is the pivoting chair structure. The pivotable chair structure includes back support 1, seat base members 2, a leg support 7, and foot supports 15. Preferably two seat base members 2, each approximately 20.5 inches in length, are pivotally connected to the top end o the vertical support 4. A hole for the pivot point is preferably positioned approximately 5.5 inches from the front end of he seat base members 2. Pivotally connected to the front ends of the seat base members 2 is a leg support 7. Preferably, a hole about one-half inch from the front end of the seat base member 2 is used to connect to the leg support 7. Pivotally connected to the rear end of the seat base members 2 is a back support 1. Preferably, a hole about one-half inch from the rear end of the seat base members 2 is used to connect to the back support 1. A hole in the back support is preferably positioned about six inches from the bottom end. Another hole in the back support is preferably positioned about one inch from the bottom, and is used to connect to two four-bar link members 3. The four-bar link members 3 are each preferably about 20 inches in length, and have holes one-half inch from each end, for example. The rear end of the four-bar link members connect to the bottom end of the back support 1 while the front end is connected to the leg support 7 at a hole preferably about five inches from the top of the leg support. Each four-bar link member has a third hole preferably about 5.5 inches from the front end. This third hole is used for a pivotable connection of the four-bar links to the vertical support 4 at a point preferably about five inches from the top end of the vertical support 4. All the connections in the chair structure described so far are pivotable connections. These connections provide for the sifting to standing movement shown in FIGS. 4A–4C. The back support 1, vertical support 4 and leg support 7 are preferably each made of about 1.75 by about 4-inch aluminum square tubing having a wall thickness of about ⅛ inch.

Figure 4A:
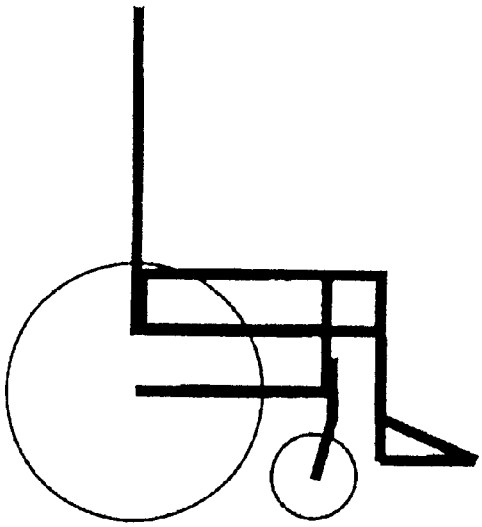
FIG. 4A is a diagram of frame members in the sitting position.
Figure 4B:
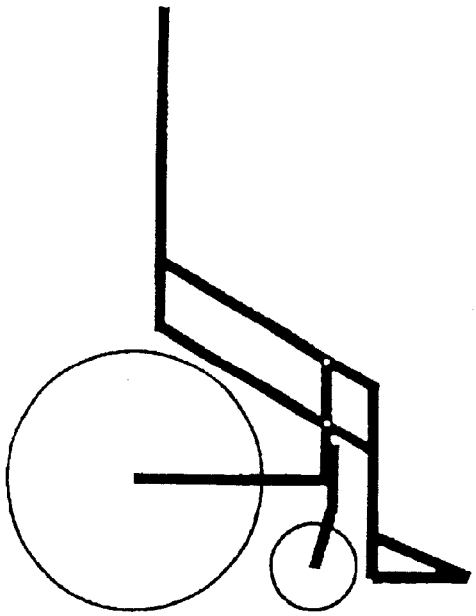
FIG. 4B is a diagram of the frame members in a position halfway between the sitting and standing position.
Figure 4C:
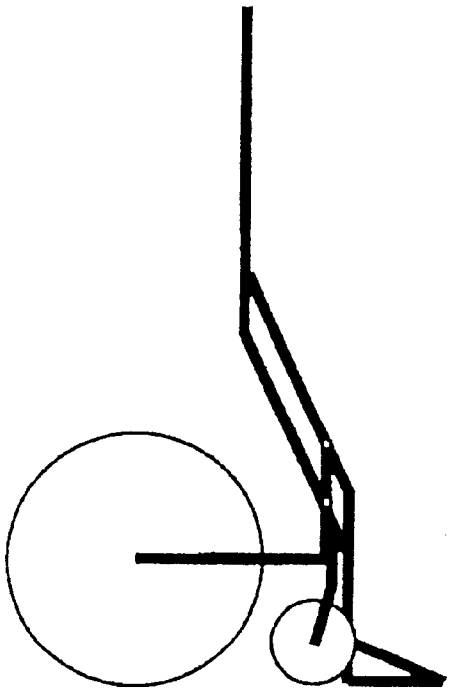
FIG. 4C is a diagram of the frame members in the standing position.

In operation, as shown in FIGS. 4A–4C, a user sifting in the wheelchair moves handle lever 38 from an off position to an on position. The lever actuates hydraulic jack system 31, and the jack system 31 raises upward, pushing on upper jack base 33, which in turn pushes on seat members 2. As the jack continues to expand upward, the back support 1 moves upward relative to seat members 2 and leg support 7 moves outward and downward relative to seat members 2. The movement of back support 1 and leg support 7 results from the tilting of seat members 2 in a forward direction. This movement continues until the wheelchair and thus the user is in an upright position. When the hydraulic jack has reached its full capability for expansion, the electronic buzzer sounds, alerting the user that the pivotable chair structure of the wheelchair has reached its full raised standing position.

To lower the pivotable chair structure, the user again moves handle 38, and the hydraulic jack system 31 begins to slowly sink down to its compact, original position. As the hydraulic jack system 31 moves downward, the user's weight pushes seat members 2 downward, resulting in the movement of seat members 2 back to their level position. This in turn causes back support 1 and leg support 7 to return to their original positions also.

It will be apparent to those skilled in the art that various modifications and variations can be made in the present invention without departing from the spirit or scope of the invention. For example, the types and sizes of materials used can be varied from those discussed in the example above. Thus, it is intended that the appended claims cover all such modifications and variations, as well as their equivalents.

What is claimed is:

1. A wheelchair especially suitable for lifting a passenger from a sitting to a standing position, the wheel chair comprising:

a central frame having a single-beam back member, a seat and a single-beam leg support member, wherein the back support member is pivotably attached to the seat support and the seat support is pivotably attached to the leg support member;

a wheel frame having a rear member and two wheels connected thereto, and a front member and two wheels connect connected thereto, wherein the front member connects to the rear member; and a lift positioned between the wheel frame and the central frame and operational to move the central frame from a sitting position to a standing position.

2. The wheelchair of claim 1, further comprising an alarm that activates when the central frame reaches the standing position.

3. The wheelchair of claim 2, wherein the alarm comprises an electrical circuit including a buzzer.

4. A wheelchair especially suitable for lifting a passenger from a sitting to a standing position, the wheel chair comprising:

a central frame having a back, a seat and a leg support, wherein the back support is pivotably attached to the seat support and the seat support is pivotably attached to the leg support, wherein the seat member of the central frame includes two upper members pivotably attached along opposite sides of the back support and along opposite sides of the leg support and two lower members pivotably attached along opposite sides of the back support and along opposite sides of the leg support, and wherein the back and the leg support each comprise a single beam;

a wheel frame having a rear member and two wheels connected thereto, and a front member and two wheels connect connected thereto, wherein the front member connects to the rear member; and a lift positioned between the wheel frame and the central frame and operational to move the central frame from a sitting position to a standing position.

5. The wheelchair of claim 4, wherein the back and leg support are each constructed of tubular aluminum.

6. The wheelchair of claim 4, wherein the central frame further comprises a pair of foot supports attached along opposite sides of the leg support, wherein an angular position defined between the leg support and the pair of foot supports may be adjusted according to the preferences of a passenger.

7. The wheelchair of claim 6, wherein the wheel frame further comprises a center member aligned substantially perpendicular to the rear member and the front member, wherein a first end of the center member connects to the rear member and a second end of the center member connects to the front member to form the connection between the front member and the rear member.

8. The wheelchair of claim 6, wherein the wheel frame further comprises a vertical member that extends above the rear member and the front member and pivotably attaches to the two upper members and to the two lower members of the seat support.

9. The wheelchair of claim 8, wherein a bottom of the lift rests upon the center member and a top of the lift presses against an upper base positioned between the two upper members of the seat support.

10. The wheelchair of claim 9, wherein the lift comprises a hydraulic jack.

11. The wheelchair of claim 9, wherein the lift comprises a ratchet and toggle mechanism.

12. The wheelchair of claim 9, wherein the lift comprises a spring and a fixed lever.

13. The wheelchair of claim 9, further comprising:

a cushioned seat that rests upon the two upper members; and a cushioned back fixedly attached to the back support.

14. A wheelchair comprising:

a lower frame coupled with a plurality of wheels;

an upper frame having a back member, a plurality of seat members, and a leg member, wherein the back member pivotably attaches to a first end of the plurality of seat members, and the leg member pivotably attaches to a second end of the plurality of seat members;

a vertical member rigidly attached to the lower frame and pivotably attached to the plurality of seat members between the first end and the second end of the seat members; and a lift having a bottom and a top, wherein the bottom rests upon the lower frame and the top presses against at least one of the plurality of seat members and when the lift is positioned between the vertical member and the first end of the plurality of seat members, wherein the lower frame comprises a single central beam that supports the lift.

15. The wheelchair of claim 14, wherein the back member and the leg member each comprise a single beam, and wherein the plurality of seat members attach along opposite sides of the back member and the leg member.

16. The wheelchair of claim 14, wherein the lift is a hydraulic jack having a pumping lever that extends along the side of the upper frame.

17. A method of lifting a passenger from a wheelchair comprising the steps of:

providing a wheelchair having a single-beam lower central frame and an upper central frame substantially aligned with the lower central frame;

operating a lift positioned between the lower central frame and the upper central frame so that the lift forces the upper central frame from a sitting position to a standing position.

18. A method of lifting a passenger from a wheelchair comprising the steps of:

providing a wheel chair having:

a central frame having a single-beam back member, a seat and a single-beam leg support member, wherein the back support is pivotably attached to the seat support and the seat support is pivotably attached to the leg support;

a wheel frame having a rear member and two wheels connected thereto, and a front member and two wheels connect connected thereto, wherein the front member connects to the rear member; and a lift positioned between the wheel frame and the central frame; and operating the lift to move the central frame from a sitting position to a standing position.

19. A method of moving a wheelchair from a sitting to a standing position comprising the steps of:

providing a wheelchair having:

a lower frame coupled with a plurality of wheels;

an upper frame having a back member, a plurality of seat members, and a leg member, wherein the back member pivotably attaches to a first end of the plurality of seat members, and the leg member pivotably attaches to a second end of the plurality of seat members;

a vertical member rigidly attached to the lower frame and pivotably attached to the plurality of seat members between the first end and the second end of the seat members; and a lift having a bottom and a top, wherein the bottom rests upon the lower frame and the top presses against at least one of the plurality of seat members and when the lift is positioned between the vertical member and the first end of the plurality of seat members, wherein the lower frame comprises a single central beam that supports the lift; and operating the lift to move the wheelchair from a sitting to a standing position.

* * * * *